United States Patent [19]

Holtermann et al.

[11] Patent Number: 4,872,648

[45] Date of Patent: Oct. 10, 1989

[54] REACTION VESSEL FOR PROCESSING STEEL

[75] Inventors: Heinz Holtermann, Meerbusch; Arno Luven, Krefeld, both of Fed. Rep. of Germany

[73] Assignee: Technometal Gesellschaft für Metalltechnologie mbH, Duisburg, Fed. Rep. of Germany

[21] Appl. No.: 231,186

[22] Filed: Aug. 11, 1988

[30] Foreign Application Priority Data

Aug. 11, 1987 [DE] Fed. Rep. of Germany ..... 3726646

[51] Int. Cl.[4] ..... C21C 7/10

[52] U.S. Cl. ..... 266/275; 266/208

[58] Field of Search ..... 266/208, 209, 275, 287

[56] References Cited

U.S. PATENT DOCUMENTS 2,893,715 7/1959 Harders et al. ..... 266/209

2,991,063 7/1961 Scheuer et al. ..... 266/209

3,125,440 3/1964 Hornak et al. ..... 266/208

*Primary Examiner*—S. Kastler

*Attorney, Agent, or Firm*—Becker & Becker, Inc.

[57] ABSTRACT

With an airtight reaction vessel having a lining of refractory material for immersion in steel-processing ladles, especially for processing steel pursuant to the vacuum circulation process, including an upper vessel part, a lower vessel part, and immersion pipes, whereby these parts are interconnected via flange rings and clamping mechanisms that hold them together, the seal between the vessel parts is to be improved in every operating state. For this purpose, it is proposed that the respectively upper main flange (17) of the associated respectively lower vessel part (11, 13, 15) have a separate upper flange ring (19) that is placed upon the resilient end of an interposed compensator ring (20) and that in the unstressed state of the flange (17, 19) extends slightly beyond the upper rim of the vessel part (11, 13, 15).

8 Claims, 3 Drawing Sheets

FIG-2
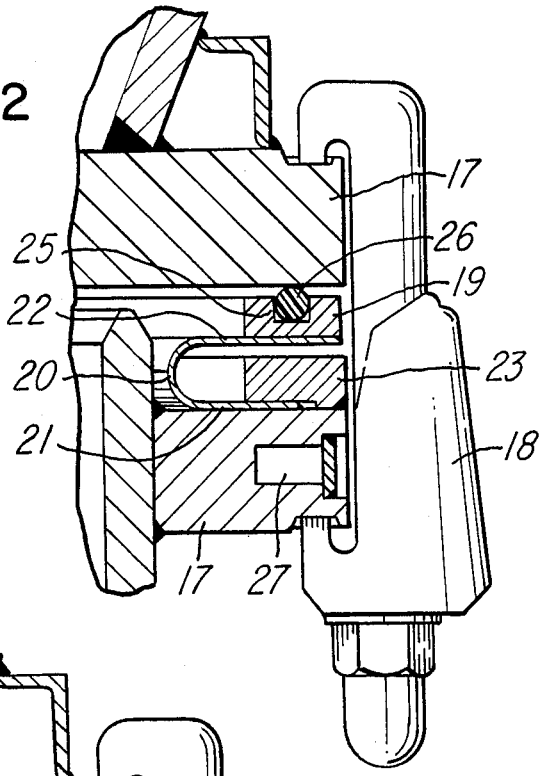
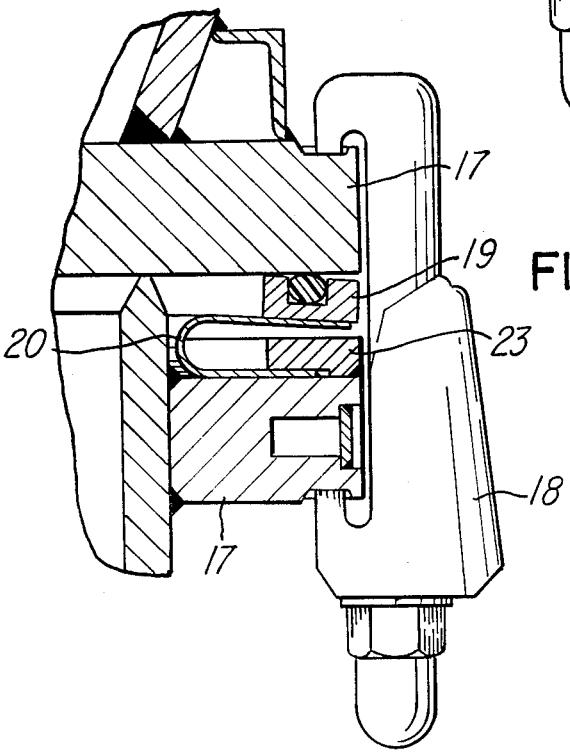
FIG-3

17
22
20
23
24
18
17

REACTION VESSEL FOR PROCESSING STEEL

BACKGROUND OF THE INVENTION

The present invention relates to a vacuum-tight or airtight reaction vessel having a lining of refractory material for immersion in steel-processing ladles, especially for processing steel pursuant to the vacuum circulation process; the reaction vessel includes an upper vessel part, a lower vessel part, and immersion pipes, with these parts being interconnected via flange rings and clamping mechanisms that pull the latter together.

When steel is processed pursuant to the vacuum circulation process, the reaction vessel, along with its immersion pipes, is immersed in the ladle, which is filled with molten steel, and an appropriate vacuum is set in the reaction vessel. By introducing conveying gas, a circulation of the molten steel is effected from the ladle, over the immersion pipes, and through the reaction vessel. Due to the varying stress on the refractory lining of the reaction vessel caused thereby, the intake portion (immersion pipes) and the lower and/or upper parts of the vessel must respectively be replaced after varying service lives.

When changing or replacing parts of the vessel, the problem arises, in the region of the plane of separation between the individual parts, of on the one hand providing a good airtight seal, and on the other hand at the same time providing a seal-shifted refractory lining. With heretofore known reaction vessels, the airtight seal is provided by flanges located on the outside of the vessel parts and subjected to an appropriate clamping pressure via clamping mechanisms; in the interior, the planes of separation between the vessel part linings, which generally comprise different refractory materials, are provided with a mortar.

Although after it is applied the refractory lining is subjected to a preheating and hence is preliminarily dried, during the course of further heating the reaction vessel to the required operating temperature, the generally basic refractory linings are suitable for relatively strong thermal expansion that leads to a significant expanding stress of those flanges of the vessel parts that are connected by the clamping mechanisms. Thus, the heretofore known reaction vessels have the drawback that either the connections are not adequately sealed, where too great of a gap is left between the linings of the vessel parts in the region of the plane of separation, or the airtight seal in the region of the main flanges cannot be adequately ensured due to the great expansion pressure originating from the refractory lining.

With a view toward reducing leaks and poor seals, further vessel constructions are known where the reaction vessel is embodied as a continuous steel body; if with such reaction vessels repair of the refractory inner lining is necessary, the vessel must first be cut open at the affected location in order to be able to carry out an operation on the inside of the vessel. After the repair work is concluded, the individual parts of the vessel must again be welded together. A considerable amount of expense is connected with such a process, and in addition there is the further drawback that the weld seams represent weak points during the rest of the working service of the vessel.

Pursuant to another known feature of such reaction vessels, the previously mentioned known flange connections between the parts of the vessel are securely welded to one another instead of interconnecting these parts with clamping mechanisms. This measure also results in the drawback that when the vessel parts are separated from one another in order to carry out repair operations on the inside of the vessel, the weld connections at the flanges are broken open, and must be replaced by new weld seams after the repair work is concluded. Repeated repair of parts of such reaction vessels, in addition to the high costs, also presents the danger that the many weld seams cannot withstand the stresses acting thereon.

It is therefore an object of the present invention to improve the reciprocal sealing of the parts of a reaction vessel of the aforementioned type in such a way that an airtight fit of the flanges results under all operating conditions.

SUMMARY OF THE INVENTION

The reaction vessel of the present invention is characterized primarily in that the upper main flange of associated vessel components is provided with a separate upper flange ring that is disposed on the resilient end of an interposed compensator ring, and which in an unstressed state of the flange connection between two associated vessel components extends slightly beyond a projection of an upper rim of that vessel component of the associated components that carries an upper main flange.

The present invention has the advantage that when the respective vessel part is placed upon the supporting vessel part, for example when the upper part of the vessel is placed upon the lower part of the vessel, a compression of the U-shaped compensator ring results due to the fact that the pertaining upper flange ring projects upwardly, so that the compensator ring is prestressed. If subsequently due to the expansion of the refractory lining an expansion of the flange connection occurs, the upper flange ring of the lower vessel part can follow the main flange of the vessel part placed thereon due to the prestress or preloading of the compensator ring, as a result of which a secure positioning of the flanges against one another is always assured.

One preferred specific embodiment of the present invention provides for the improvement, when needed, of the resilient expansion action of the U-shaped compensator ring by driving wedges into the U-bends, whereby the wedge can be supported upon a support ring that can be provided in the U-bend of the compensator ring.

With a view toward additionally improving the vacuum-tight or airtight seal, a circumferential sealing member is disposed on the upper side of the upper flange ring; this sealing member extends slightly beyond the upper surface of the flange ring, and is appropriately compressed when the upper vessel part is placed thereupon.

Finally, the main flange can be designed in such a way that it can be cooled in order to improve the durability of the material of the flange connections.

BRIEF DESCRIPTION OF THE DRAWINGS

Exemplary embodiments of the invention, which will be described subsequently, are illustrated in the drawings, in which:

FIG. 2 is an enlarged detailed view of a flange connection between two vessel parts with a large gap, FIG. 3 is a view similar to that of FIG. 2 with a refractory seal and no gap, FIG. 4 is a view similar to that of FIG. 2 with expansion wedges driven in.

DESCRIPTION OF PREFERRED EMBODIMENTS

Figure 1:
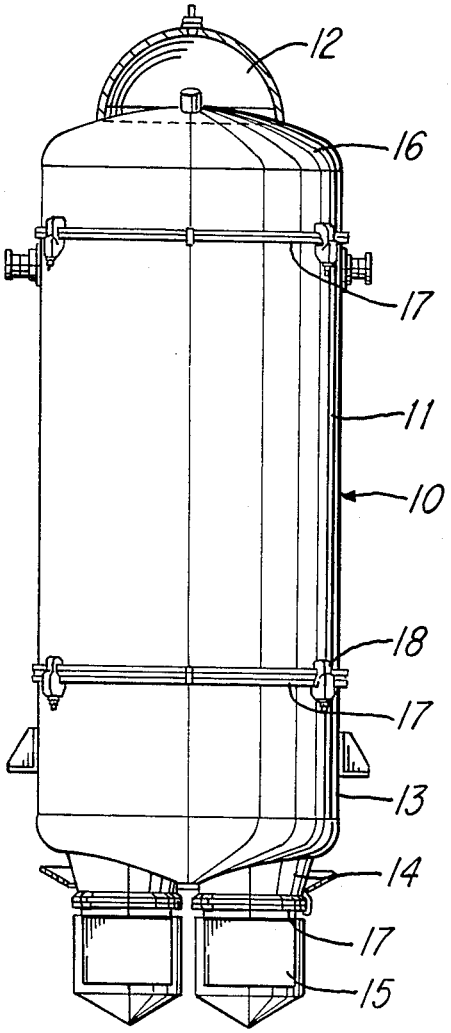
FIG. 1 is a schematic illustration of a reaction vessel.

A reaction vessel 10 comprises an upper vessel part 11, a lower vessel part 13 with continuous or through-pipes 14, and secured to the latter immersion pipes or intakes 15; the vessel is closed off at the top by a cover 16 that is provided with a vacuum connection 12. Each of the individual parts is provided with a main flange 17, with adjacent ones of said flanges being interconnected and subjected to an appropriate clamping pressure via clamping mechanisms 18 that are distributed about the periphery of the vessel.

In each case, the upper flange 17 of the upper vessel part 11, of the lower vessel part 13, as well as of each intake 15, which upper flange during assembly acts as a lower individual part, is provided in addition to the main flange 17 with an upper flange ring 19 that is coupled with the main flange 17 via a compensator ring 20. The compensator ring 20 is disposed in the manner of a horizontal U, i.e. a U that is on its side, the opening of which is directed outwardly, so that in the outer region the arms of the U are movable relative to one another, preferably in a resilient manner. The lower U-arm 21 of the compensator ring 20 is disposed on the main flange 17 and is securely connected thereto, while the outer region of the upper U-arm 22 supports the flange ring 19. As can be seen, for example, in FIG. 2, the upper edge of the upper flange ring 19 extends slightly beyond the upper rim of the associated vessel part 13, 14.

Figure 4:
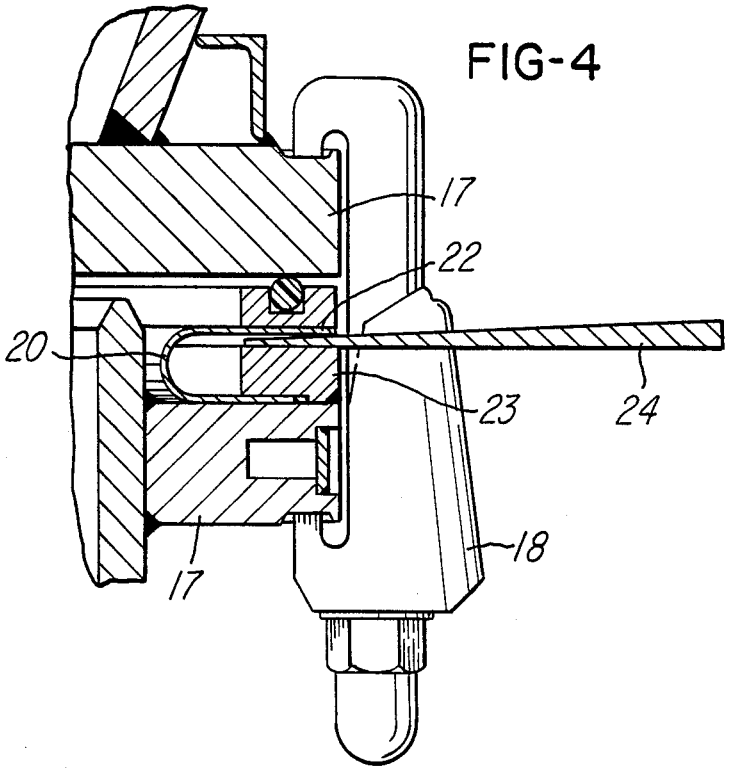

Disposed between the U-arms 21 and 22 is a support ring 23 that limits the deflection of the U-arm 22 and, pursuant to the embodiment illustrated in FIG. 4, serves as an abutment for expansion wedges 24 that are possibly to be driven-in, and that are provided for reinforcing the expanding spring action of the U-arms 21 and 22.

In order to improve the sealing connection between the flange 17 and the flange ring 19, the upper side of the upper flange ring 19 is provided with a recess 25 in which is disposed a sealing member 26, the height of which extends slightly beyond the upper edge of the flange ring 19. In addition, the main flange 17 is provided with a cooling passage 27 to allow a coolant to pass therethrough.

After the vessel parts that are to be coupled together are placed upon one another, the respective flange ring 19, due to its fixed projection beyond the vessel parts, is pressed down, as a result of which the resilient U-arm 22 of the compensator ring 20 is biased or preloaded. The clamping mechanisms 18 are subsequently placed upon the main flanges 17 and are tightened, resulting in a secure flange connection. Simultaneous with the tightening of the clamping mechanisms, the preloading in the region of the compensator ring 20 is increased, and the sealing member 26 is compressed into a position that assures the airtight seal of the connection of the vessel parts.

If when the vessel is heated to the operating temperature within the vessel 10, a thermally induced expansion of the non-illustrated refractory lining on the inner side of the vessel occurs, the flange connection 17, 19 experiences an expansion pressure, whereby however the upper flange ring 19 follows in a resilient manner a corresponding movement of the lower main flange 17 of the upper of the two vessel parts due to the given preload of the compensator ring 20, all this occurring without the flange connection 17 having to be retightened by the clamping mechanisms 18. In so doing, the sealing member 26, due to its position between the upper flange ring 19 and the lower main flange 17 of the top vessel part, assures a permanent vacuum-tight or airtight seal.

If fatigue of the material occurs in the region of the compensator shaft or ring, which can be the case especially in the region of the flange connection between the lower part 13 and the immersion pipes 15 due to the very high temperatures that exist there and also due to the replacements that are frequently required due to the short service life, expansion wedges 24 can be inserted into the open U-bend of the compensator ring 20 when the upper vessel part is placed in position; during the process of heating up the reactor vessel, the expansion wedges 24 can be driven-in further, thus reinforcing the resilient expansion action of the compensator ring 20, so that also in this situation a reliable positioning of the upper flange ring 19 against the bottom edge of the main flange 17 of an in-position upper vessel part is assured (FIG. 4). For this purpose, though not illustrated, expansion wedges having different angles of inclination can be provided; if the expansion wedges are already inserted before the clamping mechanisms are tightened, the expansion wedges have a greater pitch; if the clamping mechanisms in the operating state are already tightened and only then does a need arise for an improved expansion action of the compensator ring 20, thinner expansion wedges could also be subsequently driven-in between the resilient U-arm 22 and the support ring 23 of the compensator ring 20.

The features of the subject matter of this application disclosed in the preceding specification, the patent claims, the abstract, and the drawings can be of significance not only individually but also in any combination with one another for implementing the invention in its various embodiments. Therefore, the present invention is in no way restricted to the specific disclosure of the specification and drawings, but also encompasses any modifications within the scope of the appended claims.

What we claim is:

1. In an airtight reaction vessel having a lining of refractory material for immersion in steel-processing ladles, with said reaction vessel including an upper vessel part, a lower vessel part, and immersion pipes, with these components being interconnected via respective flange means that include, for each component, an upper main flange and a lower main flange, whereby the upper main flange of one of said components is interconnected to the lower main flange of another of said components via clamping mechanisms, the improvement wherein:

a compensator ring is disposed between the main flanges of each two associated vessel components, with said compensator ring having a first end that rests on said upper main flange of said associated components, and a second resilient free end; and said upper main flanges are each provided, as part of said flange means, with a separate upper flange ring that is disposed on said second resilient free end of said compensator ring between said compensator ring and the lower main flange of said associated components, whereby in an unstressed state of said flange means, said flange ring extends slightly beyond a projection of an upper rim of that vessel component of said associated components that carries said upper main flange.

2. A reaction vessel according to claim 1, in which said compensator ring has a U-shaped configuration, including a first U-arm that includes said first end of said compensator ring and is connected to said upper main flange, and also including a free, resilient U-arm that includes said second resilient free end and carries said upper flange ring.

3. A reaction vessel according to claim 2, in which an expansion wedge is disposed between said U-arms of said compensator ring.

4. A reaction vessel according to claim 2, in which a support ring is disposed between said U-arms of said compensator ring.

5. A reaction vessel according to claim 4, in which an expansion wedge is disposed between said support ring and said resilient U-arm of said compensator ring.

6. A reaction vessel according to claim 1, in which said upper flange ring is provided with a recess for receiving a sealing member, the height of which is slightly greater than the depth of said recess.

7. A reaction vessel according to claim 1, in which at least some of said main flanges are provided with means for cooling same.

8. A reaction vessel according to claim 7, in which said cooling means are cooling passage means formed in said flanges.

* * * * *